United States Patent [19]

Raab

[11] 3,976,120

[45] Aug. 24, 1976

[54] CASTING ARRANGEMENT FOR FORMING PLATE-SHAPED METAL PARTS

[75] Inventor: Stefan Raab, Essen, Germany

[73] Assignee: Demag Aktiengesellschaft, Duisburg, Germany

[22] Filed: Aug. 14, 1973

[21] Appl. No.: 388,248

[30] Foreign Application Priority Data

Aug. 25, 1972 Germany ..... 2241832

[52] U.S. Cl. ..... 164/330; 164/130; 164/324

[51] Int. Cl.[2] ..... B22D 23/00

[58] Field of Search ..... 164/130, 322, 323, 324, 164/329, 330

[56] References Cited

UNITED STATES PATENTS

| | | | |
|---|---|---|---|
| 697,769 | 4/1902 | Acklin | 164/329 |
| 788,834 | 4/1905 | Scott | 164/130 X |
| 788,964 | 5/1905 | Uehling | 164/130 X |
| 790,270 | 5/1905 | Baker | 164/329 |
| 1,354,975 | 10/1920 | Hurst | 164/229 |
| 2,952,054 | 9/1960 | Katzman | 164/330 |
| 3,052,934 | 9/1962 | Kerber | 164/130 X |
| 3,099,867 | 8/1963 | Ponting | 164/130 X |

FOREIGN PATENTS OR APPLICATIONS

| | | | |
|---|---|---|---|
| 529,794 | 9/1956 | Canada | 164/130 |
| 643,914 | 7/1962 | Canada | 164/130 |
| 884,860 | 7/1953 | Germany | 164/130 UX |
| 884,996 | 7/1953 | Germany | 164/130 UX |
| 1,131,850 | 6/1962 | Germany | 164/130 UX |
| 598,394 | 2/1948 | United Kingdom | 164/130 UX |

OTHER PUBLICATIONS

"Steel Making Flow Charts" American Iron and Steel Institute, 1970, pp. 3, 12.

*Primary Examiner*—Roy Lake
*Assistant Examiner*—Paul A. Bell
*Attorney, Agent, or Firm*—Toren, McGeady and Stanger

[57] ABSTRACT

In casting molten metal into open recesses in moving molds for forming plate-shaped metal parts, the molds extend between and are supported on individual links of a pair of laterally spaced link chains forming a conveyor having an upper run and a lower run and trained over a pair of spaced rolls. The upper run of the conveyor in which the molten metal is poured and cooled, travels in a rectilinear horizontal path. The links are supported on hinge pins and rollers mounted on the hinge pins ride along guide rails. Each pair of adjacent molds abut at a joint located in a vertical plane which passes through the hinge pin interconnecting the links supporting the mold. Each mold plate has a transversely arranged separating edge defining a spacer between the recesses in adjacent molds. The separating edge can be located at the end of the mold or at a location intermediate its ends. At the downstream end of the upper run, as the conveyor moves around the roll, the plate-shaped metal parts are removed from the recesses in the molds.

4 Claims, 5 Drawing Figures

CASTING ARRANGEMENT FOR FORMING PLATE-SHAPED METAL PARTS

SUMMARY OF THE INVENTION

The present invention concerns a method of and apparatus for casting plate-shaped metal parts and, more particularly, it is directed to the casting of copper anode plates within recessed surfaces in open molds as the molds travel along a horizontally arranged rectilinear path.

To obtain economical production of copper anode plates it has been known to arrange the casting molds on a large turntable, a so-called casting wheel, and to pour dosed amounts of molten copper into the mold from a point on the circumference of the table and then to rotate the table about its vertical axis by one casting mold interval or space. During casting, the turntable must not be moved to assure that the anode plates have a uniform thickness. Accordingly, the acceleration and deceleration of the turntable must be maintained at a relatively low level, otherwise the molten metal will rock in its mold. As a result, the dwell time during each pouring operation is relatively long.

To obtain a higher output, it has been suggested to provide, in addition to a melting furnace, two similar turntables and to move them alternately in a regular rhythm or tempo so that the metal can be cast into a mold on one of the turntables while the other turntable moves between casting stations. With this improved production method, the turntables can have diameters somewhat smaller than required for a single turntable, though a greater output is obtained, and, as a result, the mass to be accelerated and then decelerated is considerably smaller than when a single turntable is employed.

As indicated above, copper anode plates must be uniform, and in particular they must have the same thickness, because the service life of all the plates suspended in a bath is determined by the plate which dissolves first during the electrolysis, that is the thinnest plate. The electrolysis must be stopped before any irregular plate intervals develop due to the dissolution of a plate. If there is a lack of uniformity in the anode plates, considerable losses occur because the remaining thicker plates can only be used as recycled copper. Accordingly, the amount of molten metal to be poured into each mold must be very accurately controlled. This requirement for dimensional accuracy is the reason why the present production methods have been maintained, though they involve considerable costs and space with only a limited capacity.

Therefore, the primary object of the present invention is to cast molten metal into plate-shaped metal parts, particularly copper anode plates, which have a uniform thickness while maintaining a predetermined weight. Further, another object of the invention is to provide apparatus for carrying out the casting operation which involves a minimum of investment and operating costs.

In accordance with the present invention, open casting molds having recessed surfaces into which the molten metal is poured, are arranged in series on a horizontally moving conveyor which passes over rolls so that it has an upper run and a lower run. The recessed surfaces within the molds are separated from one another by a separating edge for defining the ends of the metal parts. As the molds move at a uniform speed on the conveyor, in the upper run initially the recessed surfaces are lined with black wash and are then continuously filled with molten metal and the metal is cooled before the completion of the passage of the mold along the upper run on the conveyor. As the conveyor moves around the roller at its downstream end, the solidified castings are automatically removed from the recessed surfaces in the molds.

Accordingly, in this casting operation uniform plates, preferably copper anode plates, can be cast to a uniform thickness without time-consuming stops and starts in the apparatus supporting the molds. The uniformity in the thickness of the plates formed is ensured, to a great extent, by the exact height of the separating edges which space the recessed surfaces in the molds apart. During the casting operation, it is only necessary to pour the exact amount of melt based on the running time of the conveyor. Accordingly, the exact dosing of the molten metal for each individual plate is eliminated.

In carrying out the casting operation, it is preferable if the molten metal is poured in a falling flat jet having a width corresponding to or slightly less than the length of the separating edge between the recessed surfaces of the molds. The length of the separating edge is selected equal to the smallest width of the plate-shaped metal part formed. Even at a relatively high circumferential speed of the conveyor, the molten metal rapidly forms a completely planar surface in the mold so that dimensional uniformity of the metal parts is assured. Further, it is preferable for the flat jet to have a directional component opposite to the direction of movement of the molds, and this feature can be easily achieved by directing the pouring spout in the direction opposite to the movement of the molds.

The circumferential speed of the conveyor can be regulated in a simple manner in dependence on the velocity of flow of the casting jet by providing a float or similar device on the pouring basin which influences the driving of the conveyor. For instance, with such an arrangement, the conveyor runs more slowly as the pouring basin is filled at a slower rate.

In addition to the advantage that the invention permits the automatic production of accurately dimensioned plates, and particularly copper anode plates, having a relatively low operating cost, there is the further advantage that the apparatus can be constructed at a low initial cost relative to its capacity. The equipment used in the casting operation includes an endless conveyor extending generally horizontally and passing over a pair of spaced rolls so that it has an upper run and a lower run. The conveyor consists of two link chains with an open casting mold extending between each pair of oppositely disposed links on the chains. The molds form serially arranged recessed surfaces separated only by a separating edge. Preferably, each pair of oppositely disposed chain links is mounted on a hinge pin having rollers at its opposite ends for movement over guide rails. As the rollers for the link chains move over the guide rails, a vibration-free and precise movement of the molds is obtained.

The abutting ends of the molds are arranged in a vertically extending plane which passes through the hinge pin connecting the links and the length of the molds are established relative to the center distances of the hinge pins so that, as the molds pass along the upper run of the conveyor, the abutting surfaces are closed by a clamping force resulting from the weight of the molds.

In certain cases the separating edge between the recessed surfaces of the molds may be located at the leading or trailing edge of the mold, so that each mold forms a complete metal part. However, in this arrangement, the metal part must be lifted out of the mold at its leading end by some sort of a special lifting device, for example, a tappet.

Accordingly, to overcome the need for lifting the metal plate out of the recessed surface in the mold, it has been suggested to stagger one complete recessed surface for forming a metal part so that it extends between two successive molds. Accordingly, the leading end of each of the plate-shaped metal parts is formed in the rearward end of a leading mold while its remainder is formed in the forward portion of the following mold. In other words, the recessed surface extends across the abutting joint between the two molds. As a result, as the conveyor moves over the roll at the downstream end of the upper run, the forward end of the plate-shaped metal part is exposed and its removal is simplified and can be accomplished by a stripping member which lifts the plate onto an inclined surface equipped with rollers for removal from the conveyor.

As the molds move along the upper run of the conveyor, and after they have been filled with the molten metal, they pass through a cooling chamber in which cooling water is sprayed downwardly and upwardly against the molds and the cast plates within their recessed surfaces.

In the interest of increasing the capacity of the casting operation, it has been suggested to arrange molds in side-by-side relationship on the pouring conveyor, so that at least two molds are filled with the molten metal at the same time. In the pouring operation, a common pouring basin can be used with a separate spout for each mold, or a separate pouring basin with its own spout can be formed for each line of molds. In this way it is possible to double the capacity of the casting apparatus without appreciably increasing its space requirement, its capital cost, or its operating costs.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
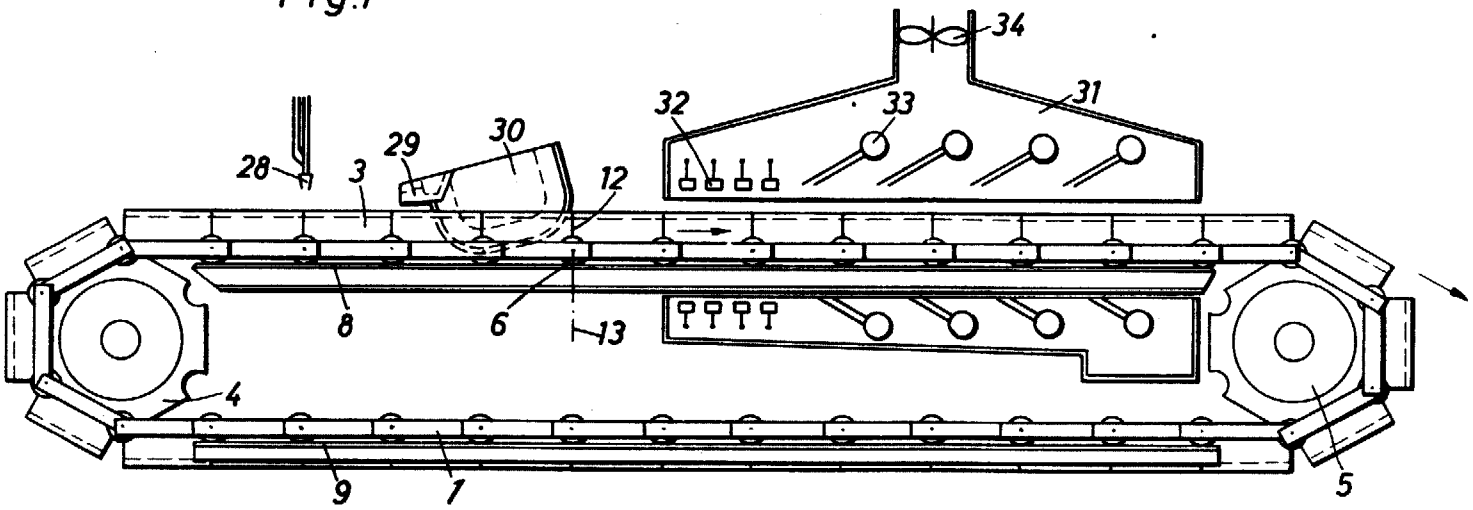
FIG. 1 is a schematic side elevational showing of apparatus for casting copper anode plates in accordance with the present invention.

In FIG. 1, a casting apparatus is illustrated consisting of an endless conveyor formed of a pair of laterally spaced link chains 1, 2 with open hematite or copper molds 3 extending between each pair of opposed links on the chains. The conveyor travels substantially horizontally and is trained over two spaced horizontally arranged rolls 4 and 5 so that the conveyor has an upper run and a lower run. The link chains 1, 2 have rollers 6 mounted on hinge pins 7 which extend between the laterally spaced link chains, and the rollers move along upper guide rails 8 and lower guide rails 9 with at least the upper guide rails positioned exactly horizontally. To assure a straight or rectilinear run of the conveyor, the rollers 6 associated with the link chain 1 are provided with flanges, note FIG. 3, which guide the movement of the conveyor over the rails.

The molds 3 have recessed surfaces 10 which correspond to the shape and dimensions of the copper anode plates 11 to be cast. The abutting surfaces of the molds 3 are arranged in a vertical plane, in at least the upper run of the conveyor, and extend through the hinge axis between the adjacent molds. To assure that the abutting surfaces 12 are closed tightly in the casting position by the weight of the molds 3, the length of the molds in their direction of movement must not be less than the center dimensions of the rollers 6, taking into consideration the expansion of the link chain.

Figure 2:
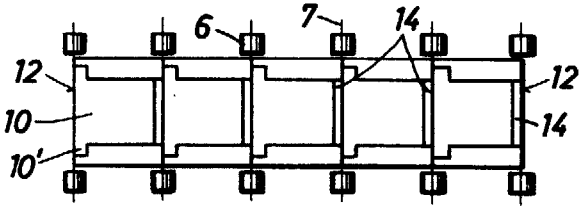
FIG. 2 is a partial top view of the apparatus in FIG. 1.

In FIG. 2, the recessed surfaces 10 are arranged so that the anode lugs 10' and the separating edges 14 are positioned at the abutting surfaces 12 between adjacent molds.

Figures 3, 4:
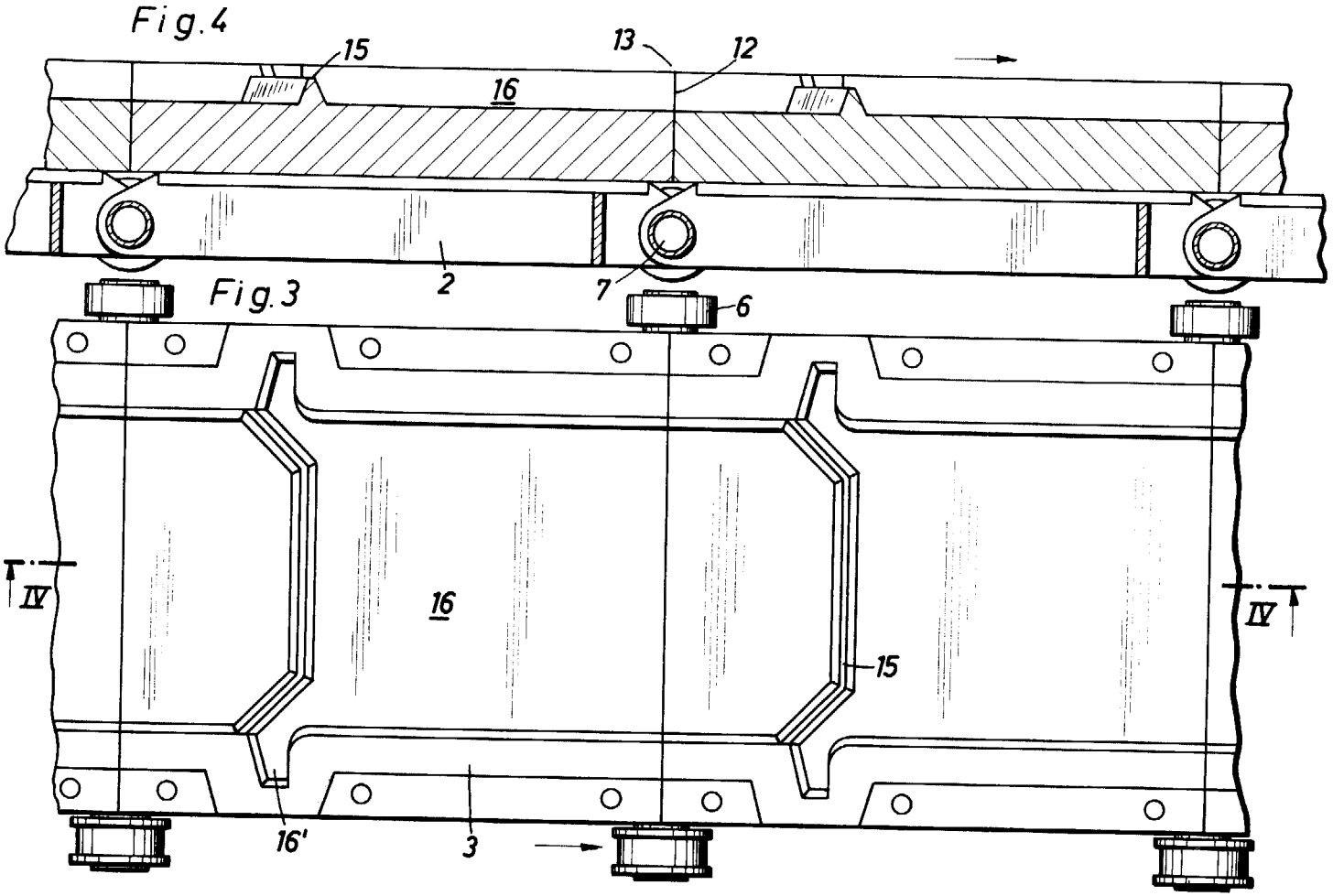
FIG. 3 is an enlarged partial top view of an apparatus similar to that shown in FIG. 1, embodying the present invention, and providing a variation in the formation of the molding surfaces.
FIG. 4 is a sectional view taken along line IV—IV in FIG. 3.
Figure 5:
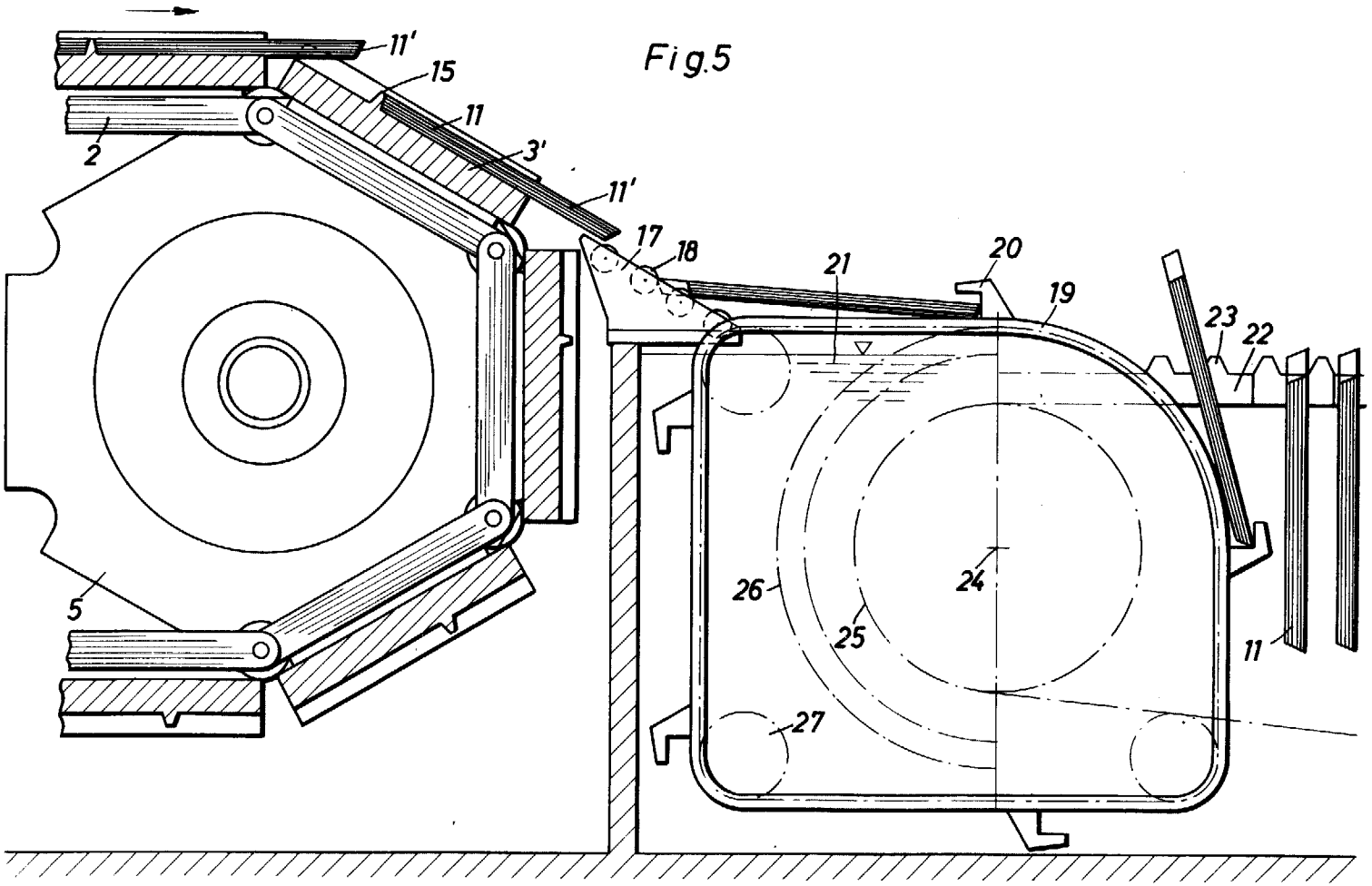
FIG. 5 is a vertical sectional view through the downstream end of the casting apparatus represented in FIGS. 3 and 4.

In a particularly advantageous embodiment of the present invention, as shown in FIGS. 3 and 4, where similar parts have the same reference numerals as in FIGS. 1 and 2, the separating edge 15, viewed in the direction of movement of the conveyor, is located approximately at the end of the second third of the mold 3. In this arrangement the abutting surfaces 12 of adjacent molds 3 are spaced from the separating edge 15 and pass through the recessed surfaces 16 intermediate their leading and trailing ends. With this arrangement, the separating edge 15 can be provided with a configuration which does not extend in a straight line transversely across the mold and the portions 16' of the recessed surfaces 16 can be formed so that the part of the anode plate positioned outside the electrolytic bath is relatively quite small, with the result that very little recycled copper remains and a savings in material is obtained. However, the primary advantage of the separating edge 15, staggered relative to the abutting surfaces 12, is that the leading end 11', note FIG. 5, of a solidified anode plate 11 is exposed as soon as the mold 3 which forms the leading end is deflected downwardly from its horizontal run over the roll 5. Accordingly, the leading end 11' of the anode plate 11 can be engaged automatically by a simple and operationally trouble-free stripper 17 for removal from the trailing mold 3 which forms the remainder of the plate. After its removal from the molds, the plate 11 slides downwardly over an inclined roller track 18 onto an endless receiving chain 19, note FIG. 5. The chain 19 is equipped with receivers 20 and runs continuously at the same speed as the conveyor supporting the molds. The receivers 20 hold the anode plates 11 and carry them into a cooling bath 21 where the plates are supported on an endless double-chain belt 22 having separating teeth 23. The separation provided by the teeth 23 is equal to the required center distance of the anode plates in the electrolytic bath. While the double-chain belt 22 moves and is deflected about the axle 24 of rotatable loose discs 25, the receiver chain 19 runs continuously over a drum 26 which also rotates about the axle 24 and over guide rollers 27.

For the continuous casting of the copper anode plates, the molds 3, moving in the direction of the arrow in FIG. 1, are first sprayed with black wash by means of a spray nozzle 28. Next, the serially arranged molds pass under the exactly regulated flat jet which issues from the wide spout 29 of a pouring basin 30 with the spout directed oppositely to the movement of the conveyor. This arrangement permits the filling of the portions 10' and 16' of the recessed surfaces 10 and 16 which form the anode lugs and are located outwardly of the width of the jet, in a positive manner and to the desired degree.

During the movement of the conveyor, after the molds pass the pouring station, the surface of the molten metal is smoothed and becomes planar. The amount of molten metal flowing continuously into the recessed surfaces 10 and 16 of the different embodiments is regulated in dependence on the speed of the conveyor so that the level of the molten metal is maintained close to the upper surface of the separating edges 14, 15. As the molds continue their movement along the upper run of the conveyor from the pouring station, they pass through a cooling chamber 31 in which shower heads 32 and nozzles 33 direct cooling water both downwardly and upwardly against the surfaces of the molds and against the surface of the plates formed in the recessed surfaces of the molds, note FIG. 1. Within the cooling chamber 31, a steam exhaust 34 is provided.

When the anode plates 11 leave the cooling chamber 31 they are completely solidified so that they automatically become detached from the molds 3 in the manner described above, when the conveyor is deflected over the roll 5, and the plates are cooled as they pass through the bath 21.

While specific embodiments of the invention have been shown and described in detail to illustrate the application of the inventive principles, it will be understood that the invention may be embodied otherwise without departing from such principles.

What is claimed is:

1. Apparatus for casting molten metal into plate-shaped parts, comprising a pair of spaced rolls having their axes arranged horizontally, an endless conveyor trained over said rolls forming an upper and a lower run each arranged approximately horizontally, said conveyor comprising a pair of laterally spaced link chains each comprising a plurality of serially arranged hinged links, an open casting mold plate supported on and extending between each pair of oppositely disposed said links in said chains and said mold plate having a recessed surface therein, each said mold plate having a transversely extending separating edge extending upwardly from the recessed surface in the upper run of said conveyor for separating successively arranged recessed surfaces formed by said mold plates, an approximately horizontal upper guide rail and a lower guide rail spaced below said upper guide rail provided for each of said chains, a hinge pin extending transversely of said conveyor between each pair of oppositely disposed links, a roller mounted on each end of said hinge pin and said rollers arranged to run on said upper and lower guide rails, the transverse ends of adjacent said mold plates being arranged in abutting engagement and the joints formed therebetween, in at least the upper run of said conveyor, being arranged in vertical planes passing through said hinge pins, said separating edge of each said mold plate being spaced from the leading and trailing ends of said mold plate and the recessed surface for the plate-shaped metal part extends between an adjacent pair of said separating edges on adjacent said mold plates with the abutting surfaces of the adjacent said mold plates located intermediate said adjacent pair of separating edges so that as each said mold plate is deflected about said roll at the end of its upper run it effects the separation of the leading end of the plate-shaped metal part while its trailing end remains supported in the following said mold plate, and means positioned at the downstream end of the upper run of said conveyor for lifting the leading ends of the plate-shaped metal parts separated from said mold plate as said mold plates move about said roll at the end of its upper run for removing the trailing end of the plate-shaped metal parts from the recessed surfaces in said mold plates and for moving the metal parts away from the downstream end of said conveyor.

2. Apparatus for casting molten metal into plate-shaped metal parts, comprising a pair of spaced rolls having their axes arranged horizontally, an endless conveyor trained over said rolls and forming an upper run and a lower run each arranged substantially horizontally, said conveyor comprising a pair of laterally spaced linking chains each comprising a plurality of serially arranged hinged links, a plurality of open casting mold plates which each said open casting mold plate supported on and extending between a pair of oppositely disposed said links in said chains and each said mold plate having a recessed surface therein for forming a plate-shaped metal part, each said mold plate having a transversely extending narrow separating edge which extends upwardly from the recessed surface in the upper run of said conveyor for separating successively arranged recessed surfaces formed by said mold plates, the end of said mold plates extending transversely of the direction of the movement of said conveyor being disposed in contacting end-to-end relation at least along the upper run of said conveyor and the joint between the contacting end of said mold plates extending vertically, a substantially horizontal upper guide rail and a substantially horizontal lower guide rail spaced below said upper guide rail is provided for each of said link chains, a hinge pin extending transversely of said conveyor for hinging together each pair of serially arranged links on each of said chains at the adjacent ends of said links, a roller mounted on each of said hinge pin and said rollers arranged to run on said upper and lower guide rails, and a pouring spout positioned above the upper run of said conveyor and arranged for pouring molten metal in a flat jet into the recesses in said metal plates with the flat jet having a width approximately equal to the smallest dimension in said metal plates measured transversely of the direction of movement of said conveyor, and said pouring spout positioned to pour the molten metal in a direction having a component of flow directed oppositely of the direction of movement of said conveyor.

3. Apparatus for casting molten metal, as set forth in claim 2, wherein said separating edges are located contiguous to the abutting end surfaces of said mold plates.

4. Apparatus for casting molten metal, as set forth in claim 2, wherein said rollers located on the same end of each of said hinge pins are flanged for engaging said guide rails and guiding the movement of said mold plates.

* * * * *